US007287927B2

(12) United States Patent
Zhang

(10) Patent No.: US 7,287,927 B2
(45) Date of Patent: Oct. 30, 2007

(54) VALVE ASSEMBLY

(75) Inventor: Jiun Zhang, Sijhih (TW)

(73) Assignee: Chuen Chern Co., Ltd., Jhonghe (TW)

( * ) Notice: Subject to any disclaimer, the term of this patent is extended or adjusted under 35 U.S.C. 154(b) by 460 days.

(21) Appl. No.: 11/084,879

(22) Filed: Mar. 21, 2005

(65) Prior Publication Data

US 2006/0210353 A1 Sep. 21, 2006

(51) Int. Cl.
*A47B 11/04* (2006.01)

(52) U.S. Cl. ..... 401/278; 401/272; 401/270

(58) Field of Classification Search ..... 401/205, 401/206, 263, 264, 270, 272–274, 278–280
See application file for complete search history.

(56) References Cited

U.S. PATENT DOCUMENTS 3,400,997 A * 9/1968 Schwartzman ..... 401/186
4,309,119 A * 1/1982 Wittersheim ..... 401/188 R
5,180,245 A * 1/1993 Iizuka ..... 401/278

* cited by examiner

*Primary Examiner*—Huyen Le
(74) *Attorney, Agent, or Firm*—C. G. Mersereau; Nikolai & Mersereau, P.A.

(57) ABSTRACT

A valve assembly includes a connector including a receiving space longitudinally defined therein and a shoulder formed on a periphery of the receiving space. The connector has a first through hole laterally defined therein. A hollow block has an annular flange radially extending from a middle portion thereof to divide the hollow block into an insertion and a connecting portion. The insertion is received in the receiving space in the connector. A sleeve has a connecting portion sleeved on the connecting portion of the hollow block and engaged to the annular flange. The sleeve is formed with a protrusion and has a skirt radially extending therefrom for being engaged to the connector. A resilient member is sleeved on the connecting portion of the sleeve. The resilient member has a first end abutting the skirt and a second end abutting the shoulder of the connector.

7 Claims, 6 Drawing Sheets

VALVE ASSEMBLY

BACKGROUND OF THE INVENTION

1. Field of the Invention

The present invention relates to valve assembly, and more particularly to a valve assembly that is mounted on an open end of a liquid container.

2. Description of Related Art

As well known, a container usually has a hollow feeder mounted on an open end thereof for draining the liquid that is contained in the container. The hollow feeder communicates with an inner periphery of the container such that the liquid flows out of the container when the container is inverted. The air will flow into the container when the container is moved to the original condition because the conventional feeder has no valve to prevent the air from flowing into the container. As a result, the liquid in the container may be oxidized due to the air that flows into the container.

The present invention has arisen to mitigate and/or obviate the disadvantages of the conventional feeder used for a liquid container.

SUMMARY OF THE INVENTION

The main objective of the present invention is to provide an improved valve assembly that can prevent the air from flowing into the container after operating.

To achieve the objective, the valve assembly in accordance with the present invention comprises a connector having a first end adapted to be mounted to an open end of a container. The connector includes a receiving space longitudinally defined in a second end thereof and a shoulder formed on a periphery of the receiving space. The connector has a first through hole laterally defined in the first end thereof. A hollow block is longitudinally mounted to the second end of the connector. The hollow block has an annular flange radially extending from a middle portion thereof to divide the hollow block into an insertion and a connecting portion. The insertion is received in the receiving space in the connector. A sleeve is longitudinally mounted to the hollow block and the connector. The sleeve has a connecting portion sleeved on the connecting portion of the hollow block and engaged to the annular flange. The sleeve is formed with a protrusion and has a skirt radially extending therefrom for being engaged to the connector. A resilient member is sleeved on the connecting portion of the sleeve. The resilient member has a first end abutting the skirt and a second end abutting the shoulder of the connector.

Further benefits and advantages of the present invention will become apparent after a careful reading of the detailed description with appropriate reference to the accompanying drawings.

DETAILED DESCRIPTION OF THE INVENTION

Figure 1:
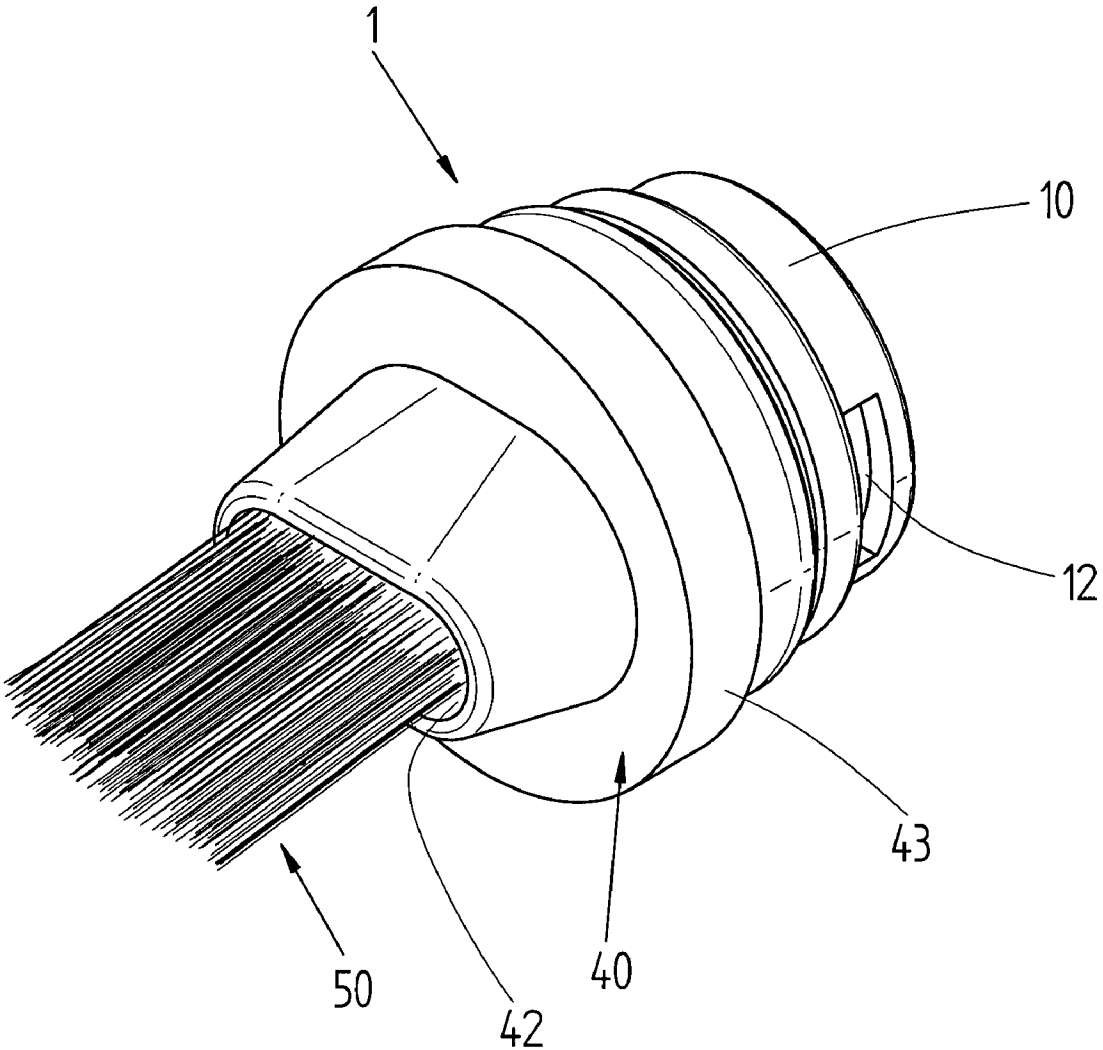
FIG. 1 is a perspective view of a valve assembly in accordance with the present invention.
Figure 2:
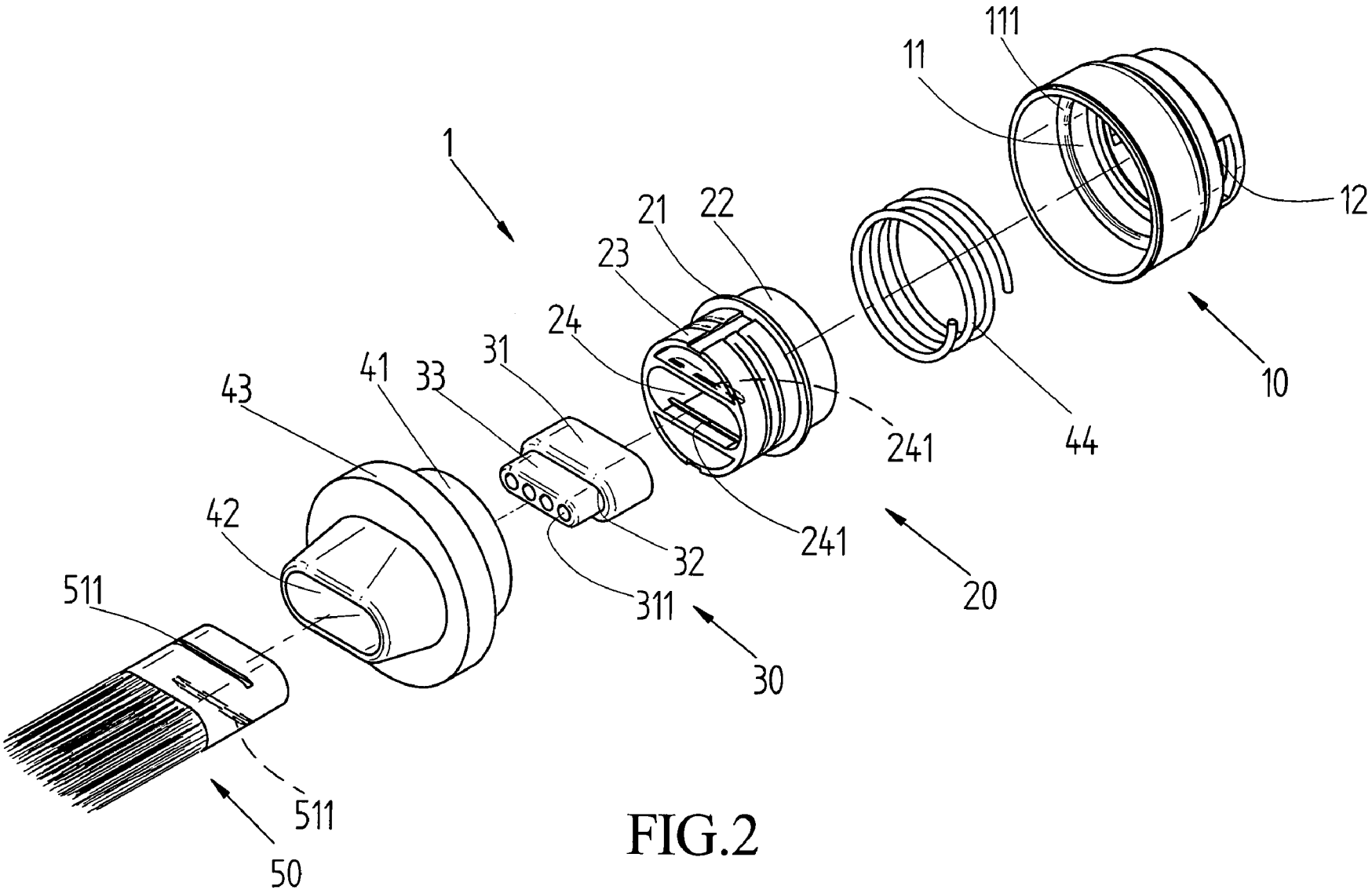
FIG. 2 is an exploded perspective view of the valve assembly in FIG. 1.
Figure 3:
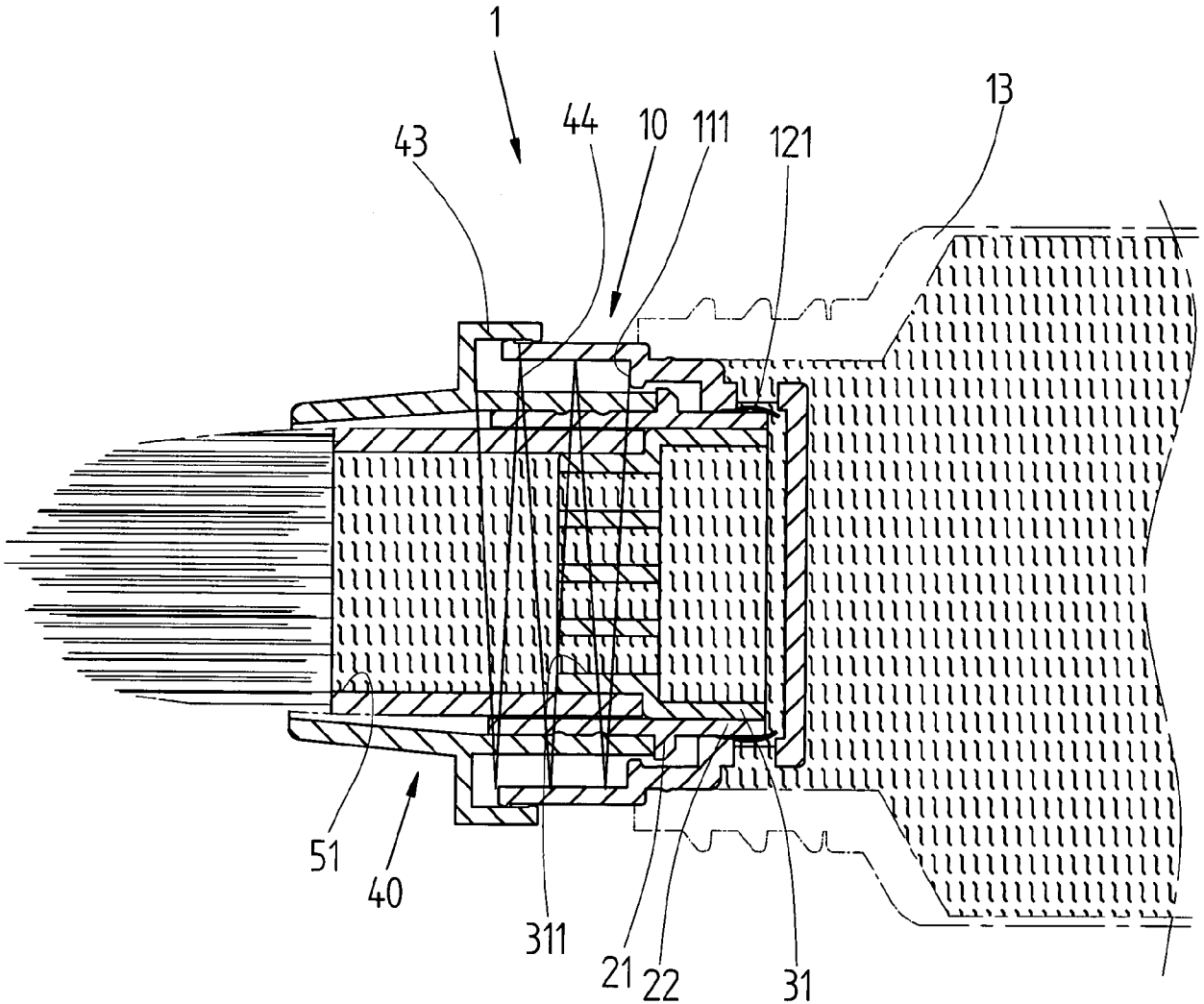
FIG. 3 is a cross-sectional operational view of the valve assembly in FIG. 1.

Referring to the drawings and initially to FIGS. 1-3, a valve assembly (1) in accordance with the present invention comprises a hollow connector (10) having a first end adapted to be mounted on an open end of a container (13). The connector (10) has a receiving space (11) longitudinally defined in a second end thereof and a shoulder (111) formed on a periphery of the receiving space (11). The connector (10) has a first through hole (12) laterally defined in the first end thereof and a valve (121) is disposed on and inner periphery of the connector (10) for selectively closing the first through hole (12).

A hollow block (20) longitudinally mounted to the second end of the connector (10). The hollow block (20) has an annular flange (21) radially extending from a middle portion thereof to divide the hollow block (20) into an insertion (22) and a connecting portion (23). The insertion (22) is received in the receiving space (11) in the connector (10). A passage (24) is centrally defined in and extending through hollow block (20) and two ribs (241) are formed on an inner periphery of the passage (24). The two ribs (241) face each other.

A nozzle (30) is disposed in the passage (24) in the block (20). The nozzle (30) includes a hollow body (31) received in the passage (24) near a bottom of the connector (10) and an outlet portion (33) longitudinally extending from the hollow body (31). The outlet portion (33) has a cross-section smaller than that of the hollow body (31) such that a shoulder (32) is formed between the hollow body (31) and the outlet portion (33). The nozzle (30) has at least one second through hole (311) longitudinally defined in the outlet portion (33) and communicating with an inner periphery on the hollow body (31). In the preferred embodiment of the present invention, the nozzle (30) has four second through holes (311) laterally corresponding to one another.

A sleeve (40) is longitudinally mounted to the block (20) and the connector (10). The sleeve (40) has a connecting portion (41) sleeved on the connecting portion (23) of the block and engaged to the annular flange (21). The sleeve (40) is formed with a protrusion (42) and has a skirt (43) radially extending therefrom for being engaged to the connector (10). A resilient member (44) is sleeved on the connecting portion (41) of the sleeve (40). The resilient member (44) has a first end abutting the skirt (43) and a second end abutting the shoulder (111) of the connector (10).

An outlet device (50) has a cylinder (51) received in the protrusion (42) and sleeved on the outlet portion (33) of the nozzle (30). The cylinder (51) communicates with the nozzle (30) and has a distal end abutting the shoulder (32) of the nozzle (30). The cylinder (51) has two slits (511) defined therein for receiving the two ribs (241) of the block (20) to hold the outlet device (50) in place. The outlet device (50) can be a brush structure, a lipstick head.

The skirt (43) of the sleeve (40) compresses the resilient member (44) toward the shoulder of the connector (10), the connecting portion (41) of the sleeve (40) abuts the annular flange (21) of the block (20) and the insertion (22) of the block (20) is moved to abut the bottom of he receiving space (11) for closing the first through hole (12) when the sleeve (40) is longitudinally forced toward the connector (10). As a result, the liquid in the container (13) can not flow out of the container (13). The resilient member (44) longitudinally pushes the sleeve (40) to make the insertion (22) of the block (20) apart from the bottom of the receiving space (11) for opening the first through hole (12) when the sleeve (40) is released from the forced condition. As a result, the cylinder (51) communicates with the first through hole (12) via the nozzle (30) and the block (20) and the liquid in the container (13) can equally flow out due to the outlet device (50) for user to conveniently apply. A pressure from the liquid in the container (13) pushes the valve (121) to open the first through hole (12) when operating and the valve (121) automatically closes the first through hole (12) after use to prevent the air from flowing into the container (13) and prevent the liquid in the container (13) from a waste due to an improper operation.

Figure 4:
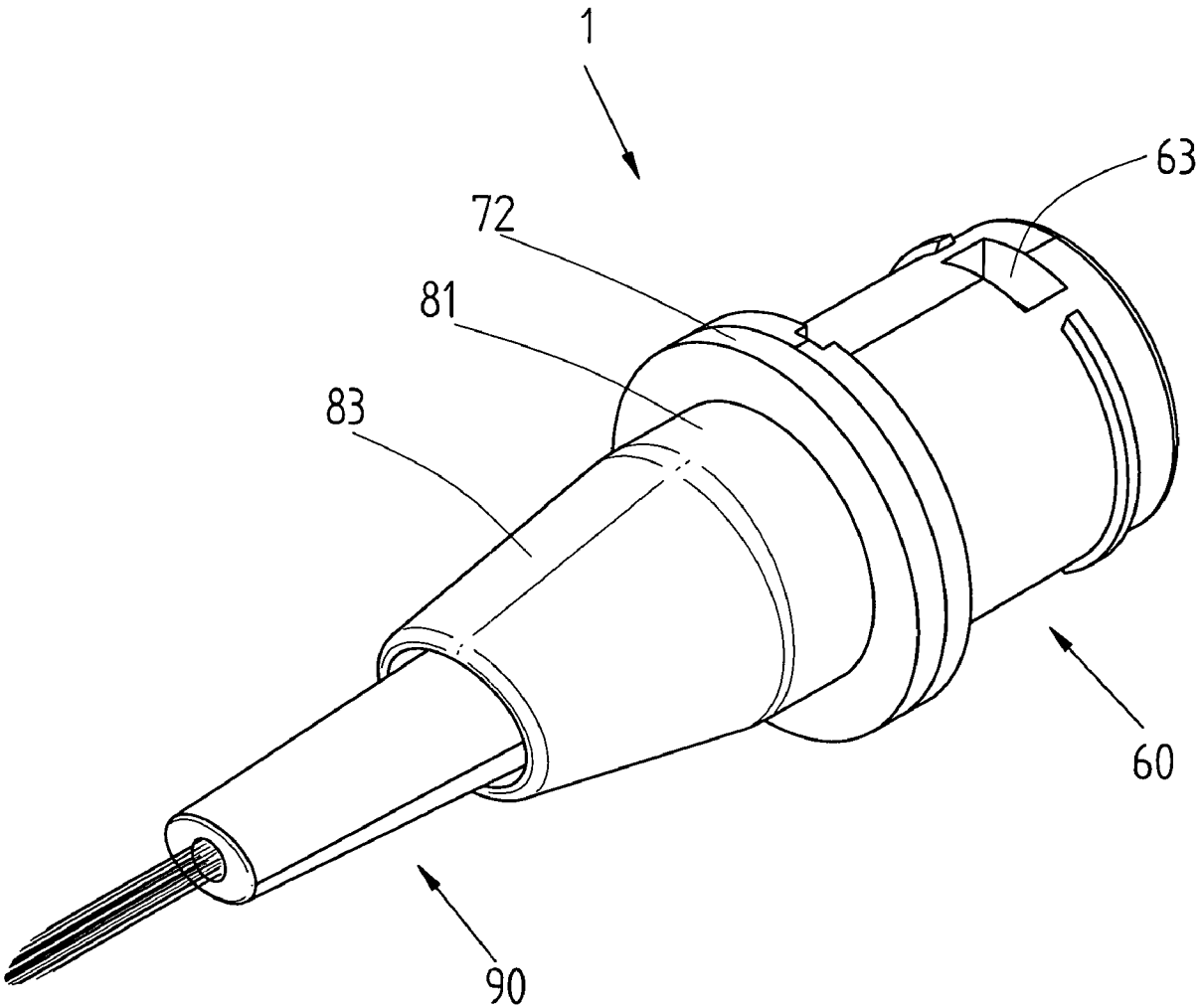
FIG. 4 is a perspective view of a second embodiment of the valve assembly in accordance with the present invention.
Figure 5:
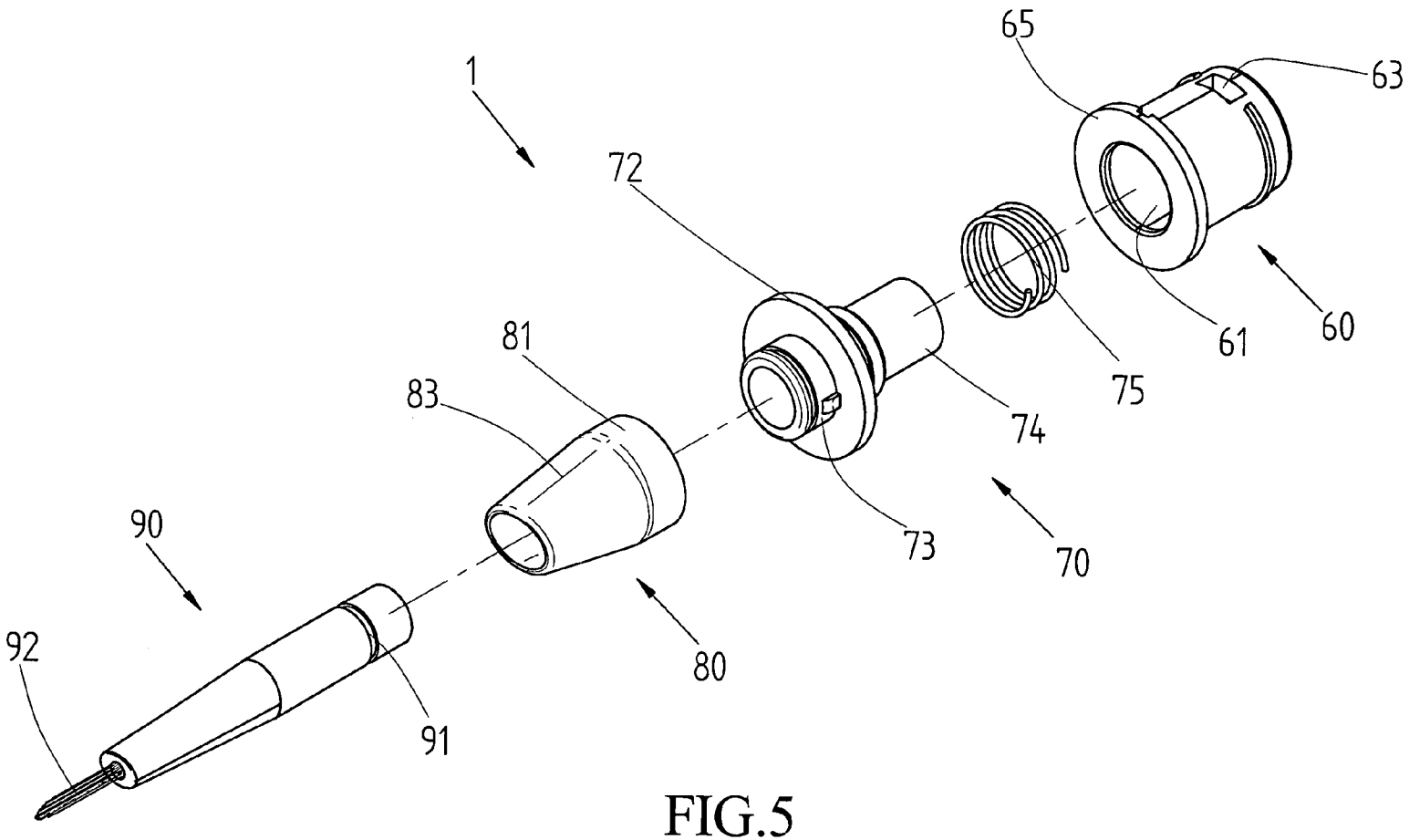
FIG. 5 is an exploded perspective view of the valve assembly in FIG. 4.
Figure 6:
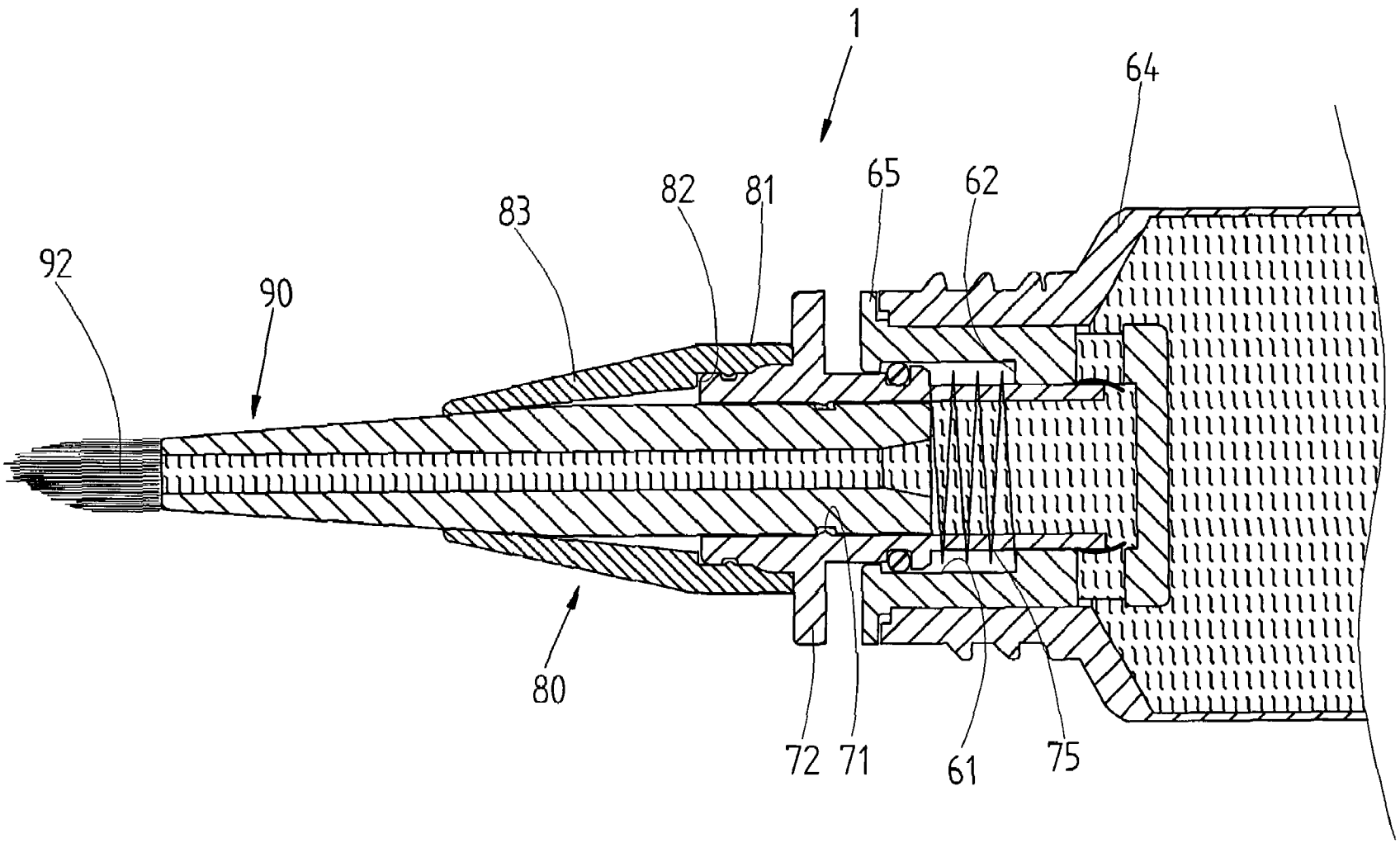
FIG. 6 is a cross-sectional operational view of the valve assembly in FIG. 4.

With reference to FIGS. 4-6 that show a second embodiment of the valve assembly in accordance with the present invention, the valve assembly (1) comprises a connector (60) having a first end adapted to be mounted on an open end of a container (64). The connector (60) has a receiving space (61) defined in the first end thereof and a shoulder (62) formed on an inner periphery of the receiving space (61). The connector (60) has two inlets (63) laterally defined in the first end thereof and communicating with the receiving space (61), and a first annular flange (65) radially extending from a second end of the connector (60). The first annular flange (65) is adapted to abut the open end of the container (64) to prevent the connector (60) overly mounted into the open end of the container (64).

A hollow block (70) is longitudinally mounted to the connector (60) and has an annular rib (71) formed on an inner periphery of the hollow block (70). A second annular flange (72) outwardly radially extends from a middle portion of the hollow block (70) to divide the hollow block (70) into a shank (74) and a connecting portion (73). The shank (74) has a diameter smaller than that of the connecting portion (73). A resilient member (75) is sleeved on the shank (74) that is received in the receiving space (61) to make the resilient member (75) abut the shoulder (62) of the connector (60).

A sleeve (80) is longitudinally mounted to the hollow block (70). The sleeve (80) has a connecting portion (81) sleeved on the connecting portion (73) of the hollow block (70) and a tapered portion (83) formed opposite to the hollow block (70). A shoulder (82) is formed on an inner periphery of the sleeve (80) to abut a distal end of the connecting portion (73) of the hollow block (70).

An outlet device (90) extends through the sleeve (80) and engaged to the hollow block (70). The outlet device (90) has an annular groove (91) defined therein for receiving the annular rib (71) of the hollow block (70) to hold the outlet device (90) in place. The outlet device (90) has a brush structure (92) mounted longitudinally attached thereto opposite to the hollow block (70).

The follow block (70) compresses the resilient member (75) toward the connector (60) and the shank (74) is moved to abut a bottom of the receiving space (61) for closing the inlets (63) when the hollow block (70) is longitudinally forced toward the connector (60). As a result, the liquid in the container (64) can not flow out of the container (64). The resilient member (75) longitudinally pushes the hollow block (70) to make the shank (74) apart from the bottom of the receiving space (61) for opening the inlets (63) when the hollow block (70) is released from a forced condition. As a result, the inlets (63) communicate with the outlet device (90) and the liquid in the container (64) can equally flow out due to the outlet device (90) for user to conveniently apply.

As described above, the valve assembly in accordance with the present invention includes several advantages as follow.

1. The outlet device of the present invention can be easily replaced for different operation such that the using scope of the present invention is wide.

2. The valve assembly of the present invention is suitable to various containers. As a result, the user does not need to prepare multiple valve assembly.

3. The valve of the present invention can automatically close the connector to prevent the air from flowing into the container after operating. Consequently, the liquid in the container can be kept in an airtight condition.

4. The closed connector of the present invention can prevent the liquid in the container (13) from a waste due to an improper operation.

Although the invention has been explained in relation to its preferred embodiment, it is to be understood that many other possible modifications and variations can be made without departing from the spirit and scope of the invention as hereinafter claimed.

What is claimed is:

1. A valve assembly comprising:

a connector having a first end adapted to be mounted to an open end of a container, the connector including a receiving space longitudinally defined in a second end thereof and a shoulder formed on a periphery of the receiving space, the connector having a first through hole laterally defined in the first end thereof;

a hollow block longitudinally mounted to the second end of the connector, the hollow block having an annular flange radially extending from a middle portion thereof to divide the hollow block into an insertion and a connecting portion, the insertion received in the receiving space in the connector; and a sleeve longitudinally mounted to the hollow block and the connector, the sleeve having a connecting portion sleeved on the connecting portion of the hollow block and engaged to the annular flange, the sleeve formed with a protrusion and having a skirt radially extending therefrom for being engaged to the connector, a resilient member sleeved on the connecting portion of the sleeve, the resilient member having a first end abutting the skirt and a second end abutting the shoulder of the connector.

2. The valve assembly as claimed in claim 1, wherein the hollow block comprises a passage centrally defined therein and extending therethrough, a nozzle disposed in the passage, the nozzle including a hollow body received in the passage near a bottom of the connector and an outlet portion longitudinally extending from the hollow body, the outlet portion having a cross-section smaller than that of the hollow body such that a shoulder is formed between the hollow body and the outlet portion, the nozzle having at least one second through hole longitudinally defined in the outlet portion and communicating with an inner periphery on the hollow body, the nozzle having two ribs formed on an inner periphery of the passage and facing each other.

3. The valve assembly as claimed in claim 2 further comprising an outlet device having a cylinder received in the protrusion and sleeved on the outlet portion of the nozzle, the cylinder communicating with the nozzle and having a distal end abutting the shoulder of the nozzle, the cylinder having two slits defined therein for receiving the two ribs of the hollow block to hold the outlet device in place.

4. The valve assembly as claimed in claim 3, wherein the outlet device is a brush structure.

5. The valve assembly as claimed in claim 3, wherein the outlet device is a lipstick head.

6. The valve assembly as claimed in claim 2, wherein the nozzle has four second through holes laterally corresponding to one another.

7. The valve assembly as claimed in claim 1, wherein the connector comprises a valve disposed on and inner periphery of the connector for selectively closing the first through hole.

* * * * *